US007214169B1

(12) United States Patent
Clayton

(10) Patent No.: US 7,214,169 B1
(45) Date of Patent: May 8, 2007

(54) PORTABLE AND FULLY ADJUSTABLE PUNCHING BAG EXERCISE SYSTEM

(76) Inventor: William W. Clayton, 604 Finley St., Cedar Hill, TX (US) 75104

( * ) Notice: Subject to any disclaimer, the term of this patent is extended or adjusted under 35 U.S.C. 154(b) by 112 days.

(21) Appl. No.: 10/794,916

(22) Filed: Mar. 6, 2004

Related U.S. Application Data

(60) Provisional application No. 60/452,784, filed on Mar. 8, 2003.

(51) Int. Cl.
*A63B 69/26* (2006.01)
*A63B 69/30* (2006.01)

(52) U.S. Cl. ..... 482/88; 482/83; 482/86; 482/87

(58) Field of Classification Search ..... 482/83–90; D21/787, 797
See application file for complete search history.

(56) References Cited

U.S. PATENT DOCUMENTS

| | | | | | |
|---|---|---|---|---|---|
| 717,273 | A | | 12/1902 | Reach | |
| 815,677 | A | * | 3/1906 | Bryon, Jr. | 482/87 |
| 1,049,835 | A | | 1/1913 | Finney | |
| 2,012,899 | A | | 8/1935 | Thorson | |
| 2,400,105 | A | * | 5/1946 | Costello | 482/88 |
| 2,677,545 | A | | 5/1954 | Ross | |
| 3,030,109 | A | * | 4/1962 | Albitz | 482/88 |
| 3,542,364 | A | | 11/1970 | Gaumond | |
| 4,121,822 | A | * | 10/1978 | DiSabatino et al. | 482/88 |
| 4,239,209 | A | | 12/1980 | Curchod | |
| 4,660,827 | A | | 4/1987 | Servadio | |
| 4,911,432 | A | * | 3/1990 | Walden | 482/148 |
| 4,961,573 | A | * | 10/1990 | Wehrell | 482/74 |
| 5,147,258 | A | | 9/1992 | Donohue | |
| 5,224,912 | A | * | 7/1993 | Moody | 482/87 |
| 5,286,241 | A | * | 2/1994 | Petrakis | 482/87 |
| 5,674,157 | A | | 10/1997 | Wilkinson | |
| 5,722,920 | A | * | 3/1998 | Bauer | 482/83 |
| 5,803,877 | A | | 9/1998 | Franey | |
| 5,944,639 | A | * | 8/1999 | Ray | 482/87 |
| D440,269 | S | | 4/2001 | Thomas | |

* cited by examiner

*Primary Examiner*—Stephen R. Crow
*Assistant Examiner*—Allana Lewin
(74) *Attorney, Agent, or Firm*—F. Lindsey Scott

(57) ABSTRACT

A portable, fully adjustable punching bag exercise system is disclosed whereby a punching bag structure is releasably mounted to the waist of a user and is fully adjustable to any height or distance in front of the user for use in physical training. The punching bag is supported in any orientation via attachment to a spring means which is adjustable in order to control the speed or action of the bag to suit users of varying skill levels. A preferred embodiment also has an optional rebounding means that is fully adjustable for the further control of the effective speed or action of the bag by adjusting the maximum angular deviation of the bag relative to its support mechanism at which the bag is caused to bound back toward the user. Alternative embodiments include resistance straps which elastically couple the belt assembly to the user's hands in order to provide resistance to the punching motion for enhanced physical training and a multi-bag design which provides for enhanced dexterity training.

4 Claims, 6 Drawing Sheets

PORTABLE AND FULLY ADJUSTABLE PUNCHING BAG EXERCISE SYSTEM

CROSS-REFERENCE TO RELATED APPLICATIONS

This application claims priority under 35 U.S.C. 119(e) on U.S. Provisional application No. 60/452,784 entitled BELT MOUNTED, FULLY ADJUSTABLE PUNCHING BAG EXERCISE DEVICE, filed on Mar. 8, 2003, by William W. Clayton and Carrie M. Clayton.

FIELD OF INVENTION

This invention relates to exercise devices, and more particularly, to a portable and fully adjustable punching bag exercise system which enables the practice thereof at virtually any location. Varying releasable punching bag mounting means are provided which allows the punching bag exercise system to be adaptably mounted to differing types of structures in order to enhance the available exercise modes and regimens provided thereby.

BACKGROUND OF THE INVENTION

Numerous devices have been developed for the sport of boxing that provide aerobic as well as anaerobic conditioning in addition to enhancing the eye/hand coordination of the boxer. An example of one of these devices is a punching bag or "speed bag" which generally comprises a resilient inflatable bag that is swivelly mounted to a rigid support structure. The inflatable bag is generally light in weight and resilient in nature thus imparting a bounce action when struck by a fast moving object such as a fist of a user.

Traditionally, the rigid support structure has been characterized by a flat generally horizontally oriented planar board which is mounted to a wall, ceiling, or other like structure and is positioned at a height at or slightly above the user's head. Upon being struck by the fist of a user, the bag is caused to swivel rapidly upon its swivelly mounted connection. The speed of the inflatable bag is accentuated by a bouncing action that occurs when contacting the planar board at high speeds. The drawback of this type of device is that the rigid support structure must be made relatively large and as such, requires cumbersome attaching means for attachment to a ceiling, wall, or other structure. In addition, the board must be sufficiently secured to the ceiling in order to minimize excessive reverberations caused by the inflatable bag bouncing off of the planar board and thus does not easily lend itself to a portable mounting arrangement which can be removed and placed in storage following each exercise session. Another drawback of this type of device is that the relative speed at which the punching bag moves through its available range of motion is dictated substantially by the size of the punching bag. Thus a novice user must use a larger punching bag which moves slower due to its longer arcuate motion and softer bounce off of the planar board. As the agility and skill of the user increases, another smaller bag which has a faster motion must be purchased; that is, a single punching bag is not adaptable to users of varying skill levels.

Various devices have been proposed that enable the portable use of a punching bag and examples of such devices include Pat. No. 3,030,109 to Albitz, and Pat. No. D440,269 to Thomas. Although both of these devices are portable in nature, they are cumbersome and difficult to use and store due to the necessity of a conventional planar board which is relatively large in size. The angular resonant frequency or speed of the punching bag is defined as the inverse of the natural cyclicle period at which the punching bag swings through its arcuate motion. The use of the planar board has served to decrease the effective cyclicle period and thus inversely increase the speed or action of the bag by providing a rebounding action thereto. Thus, although the use of the planar board as described by Albitz and Thomas is relatively large and cumbersome, it does serve to increase the speed or action of the bag thereby providing a challenging and useful workout for the user. Pat. No. 2,400,105 to Costello discloses a portable punching bag device having releasable mounting means suited for releasable attachment to the waist of a user, however no provisions have been made which allows for selective adjustment of the angular resonant frequency or speed of the bag. In addition, no means are provided to increase the speed or action of the bag using a planar board or other similar device. The '105 device also describes no releasable mounting means to any structure other than a waist mounted arrangement. That is, the '105 device does not teach, nor suggest the use of a punching bag which is adaptable for releasable attachment to varying types of structures. In addition, U.S. Pat. No. 5,607,377 to Wilkinson discloses a punching bag device having a resilient rod member for imparting a resonant pendulum-like action thereto. However the '377 device does not disclose nor teach any means of changing the effective speed or action of the punching bag without also necessitating modification of the height of the bag relative to the user.

There has thus been a long-felt, unsatisfied need for a portable punching bag exercise system that is light and portable for use at any location. The punching bag arrangement should be structurally sound in order to allow repeated use without failure and following use, can be packaged into a small space for easy storage. Optionally, the effective speed of the punching bag about its swivel mount should be adjustable so that users of varying skill levels will be able to practice without the need to purchase an assortment of variable sized punching bags for use thereon.

SUMMARY OF THE INVENTION AND OBJECTIVES

The present invention provides a solution to these needs as well as other needs via a portable, fully adjustable punching bag exercise system. The system includes a punching bag which is attached to a spring means which positions the bag in any preselected orientation when at rest. The orientation of the punching bag is defined as the angular direction that the bag faces when the spring means is in its quiescent state. The resilience of the spring means is optionally adjustable in order to allow selective modification to the speed or action in which the bag moves during use. In addition, optionally adjustable rebounding means are provided which further enhances the effective speed or action of the bag by incorporating a bouncing action of the resilient bag against a rigid surface in a similar manner to conventional planar backboards. Preferred embodiments include punching bag mounting means which provides for releasable attachment to the waist of a user in addition to providing releasable attachment to other types of exercise equipment such as exercise bars, conventional punching bag structures, stationary bicycles, and the like. In addition, multiple bags may be configured together in order to provide a punching bag practice device which further challenges the skill of a user.

A preferred embodiment of the present invention is disclosed wherein a punching bag is mounted via an adjustable length stem onto a belt which extends around the user's waist for support therefrom. The angle of the extension rod with respect to the belt, in addition to the length thereof, is proportionally adjustable to suit users of any size and arm length. The punching bag is swivelly connected to the extension rod via a spring means which biases the punching bag in the generally upright position. Optionally, an adjustable rebounding means is adjustably mounted to the lower portion of the spring means so that the punching bag is allowed to bounce therefrom in order to effect a means whereby the effective speed or action of the bag is fully adjustable by the user. Other preferred embodiments include punching bag mounting means which are adapted for releasable connection to firm foundational structures such as exercise bars, and the like or even other boxing exercise devices such as heavy bags.

One aspect of the present invention contemplates the use of a spring means for flexible, resilient support of the punching bag in a predetermined user selected orientation. Thus, the use of the punching bag exercise system of the present invention no longer requires that the bag dangle in a downwards depending direction from its support apparatus while in use. The use of the spring means allows the bag to be positioned in any orientation including a generally upright as well as a generally sideways orientation. Optionally, the spring means may operate in conjunction with a linear tensioning means in order to allow the user to modify the effective speed of the punching bag about its support structure and thus control the speed or action of the bag. Thus a user will be able to modify the speed of the punching bag to suit his or her tastes as well as current skill level without the need to purchase extra bags.

Another aspect of the present invention is a spring means which may be a standard metallic spring or made from an elongated section of resilient composite material such as shock corded fiberglass, graphite fiber rod, or other similarly suitable material. A preferred embodiment is disclosed which utilizes an elongated section of fiberglass impregnated polyester rod which presents the necessary resiliency to impart a cyclic pendulum action to the bag upon being struck by a user and is sufficiently durable to resist breaking during normal use. The natural speed of the bag may be engineered to any acceptable level by adjusting the grade of composite used, as well as the thickness and length of the rod.

It is therefore an object of the present invention to provide a portable, fully adjustable punching bag exercise system which is releasably mountable to any firm foundational structure for practice of the sport of boxing.

A further object of the present invention is to provide a portable, fully adjustable punching bag exercise device which is releasably mounted to a user's waist for practice of the sport of boxing. The device is fully adaptable for users of varying sizes and arm lengths by providing adjustable means in order to position the punching bag at any desired location in front of the user.

It is another object of the present invention to provide a portable, fully adjustable punching bag exercise system which is lightweight and easily stored. The punching bag device is releasably mountable to any stable, rigid platform for structural support therefrom and thus does not require any permanent or heavy and cumbersome mounting mechanisms. Therefore, the device may be used at any location and easily stored following each use.

It is another object of the present invention to provide a portable, fully adjustable punching bag exercise device in which the angular velocity of the punching bag is adjustable via a resiliency adjustment means which provides for controlling the effective speed and thus the speed or action of the bag in order to suit users of varying skill levels.

Another related object of the present invention is to provide a portable, fully adjustable punching bag device having a rebounding means which is fully adjustable for the further control of the speed or action of the bag by enabling the adjustment of the maximum angular deviation of the bag relative to its support mechanism at which the bag is caused to bounce back towards the user. Alternatively, the user may easily remove the backstop from the punching bag device if the aforementioned bounce action is not desired.

These and other objects of the present invention will become readily apparent to those familiar with the construction and use of punching bag devices and will become apparent in the following portions of the specification, wherein the detailed description is for the purpose of fully disclosing preferred embodiments of the invention without placing limitations thereon.

BRIEF DESCRIPTION OF THE DRAWINGS

For a more complete understanding of the present invention, and the advantages thereof, reference is now made to the following descriptions taken in conjunction with accompanying drawings, in which.

DETAILED DESCRIPTION OF THE PREFERRED EMBODIMENTS

Figure 1:
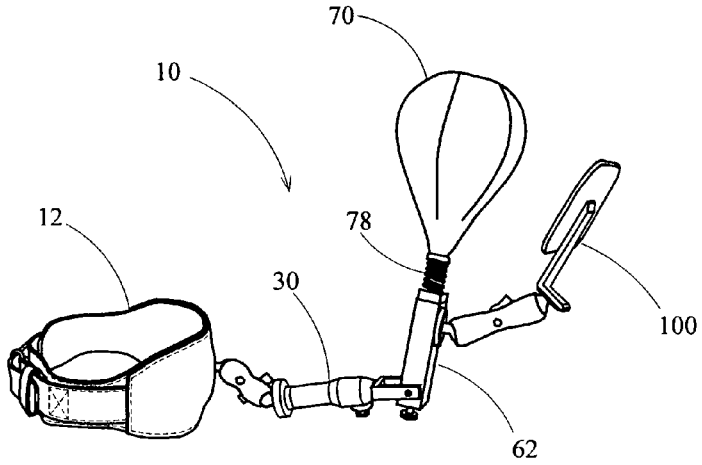
FIG. 1 is a perspective view of one preferred embodiment of the present invention with the adjustable length stem in the fully contracted position.

Referring now to the drawings, FIGS. 1–14 represent several embodiments and designs of a punching bag exercise system which is portable and easily adaptable for use in any environment. Each of the various embodiments, however, share the commonly novel feature of at least one conventional punching bag which is attached to various structural objects by a resiliently adjustable spring means for resilient support thereof in any user selectable orientation. A first embodiment depicting a device 10 of the present invention having a punching bag mounting means which is adapted for releasable attachment to the torso or waist of a user is shown in FIGS. 1 through 5. The punching bag device 10 has a belt assembly 12 for releasable securement around a user's waist, and an adjustable length stem 30 which is swivelly connected to the belt assembly 12 at its proximal end. The adjustable length stem 30 is rotatably connected to a canister assembly 60 at its distal end thereby allowing said canister assembly to be rigidly disposed at any distance, angle, and orientation from the user's waist. The canister assembly 60 has a generally hollow interior section and has a spring means comprising a metallic compression spring 78 disposed upon the upper aperture thereof for resilient support of a punching bag 70 in a generally upright position. The punching bag device also has a backstop 100 which causes the punching bag 70 to rebound back towards the user when struck, is swivelly mounted to the canister assembly 60 and is user selectively positioned at a any distance, and orientation behind the bag.

Figure 3:
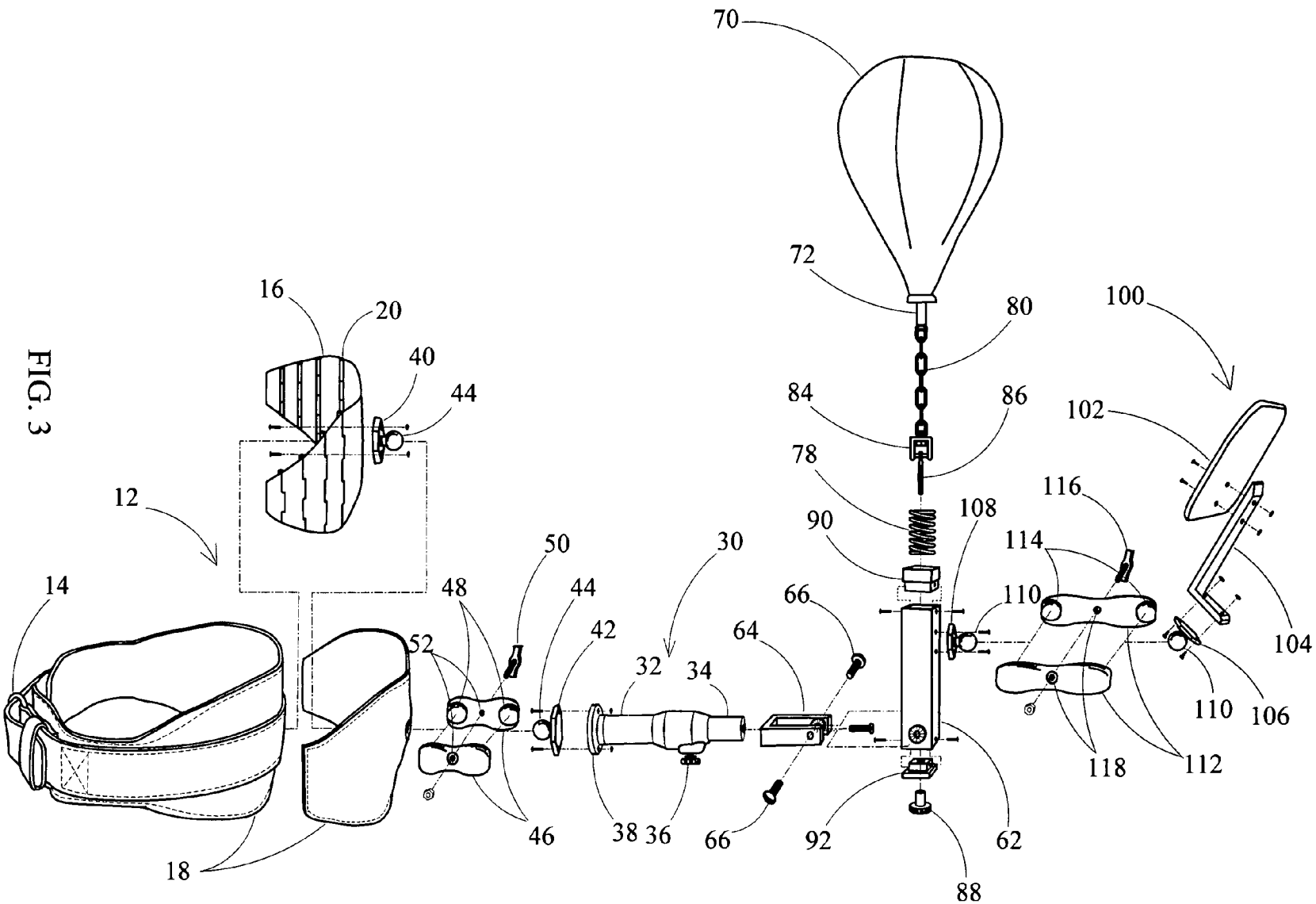
FIG. 3 is a perspective exploded view of the embodiment of FIG. 1.

As shown in FIG. 3, the belt assembly 12 embodying the present invention is constructed of an elongated section of material, preferably top-grain leather, or the like and contains a buckle arrangement 14 for releasable attachment around a user's waist. The present embodiment utilizes a buckle arrangement however it is well known in the art that other releasable attachment means such as hook-and-loop releasable attachment means may also be used. A belt stiffener 16 which has a ball mount arrangement 30 attached to its front surface is sandwiched in between two additional pieces of backing material 18. The belt stiffener 16 is formed from 16 guage steel having hinges 20 whose axes extend vertically in order to allow the belt assembly 12 to bend easily along its elongated extent. Nevertheless, it is well known in the art that the belt stiffener 16 may be made from metal or any material that would provide structural integrity for the punching bag assembly by abating excessive warping or bending of the belt assembly during normal use. Both pieces of backing material, preferably made of top-grain leather are dimensioned to be slightly larger then the belt stiffener 16 and are attached around the entire periphery of the belt stiffener 16 using stitches, or other suitable attachment means.

The adjustable length stem 30 comprises an elongated section of plastic or the like defining a hollow cylinder 32 into which a plastic extension rod 34 may be placed therein and held in position using a thumbscrew 36. The outside diameter of the extension rod 34 is slightly smaller than the inside diameter of the hollow cylinder 32 whereby the extension rod may be slidably received thereinto thus forming a structure whose effective length can be easily manipulated between a shorter contracted position and a longer extended position. The thumbscrew 36 is a simple bolt structure that has an enlarged head for easy access by a user and is threadably receivable into a like threaded aperture (not shown) which is attached to the side of the cylinder 32. The proximal end of the adjustable length stem 30 has a flange 38 for attachment to a ball mount arrangement 42. The ball mount arrangements (40 and 42) each have a ball 44 which is swivelly mounted in sockets formed by two elongated pieces of material defining a dual socket arrangement 46 having concave socket cavities 48 located at the ends to receive each ball therein. The ball mount arrangements (40 and 42), and dual socket arrangement 46 may be constructed of any suitable material, preferably lightweight aluminum. A bolt 50 extends through holes 52 intermediate the socket cavities of the dual socket arrangement 46 and serves to rigidly hold the adjustable length stem 30 at any user selectable angular orientation with respect to the belt assembly 12 when tightened.

Figure 4:
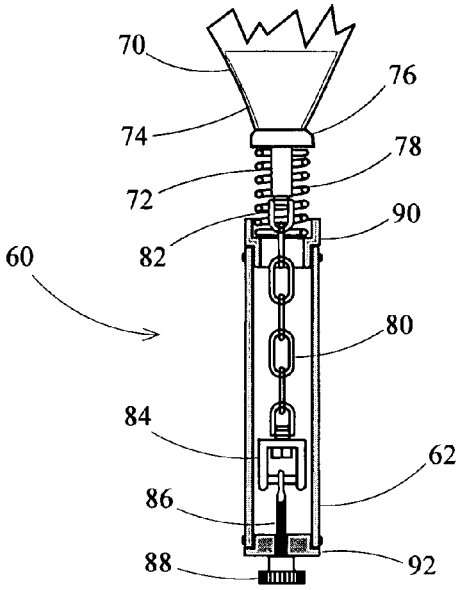
FIG. 4 is an elevational sectional view of the embodiment of FIG. 1 with the front side of the spring, canister, and end-pieces cut away to show the arrangement of the components of the canister assembly.

As shown in FIGS. 3 and 4, the canister assembly 60 embodying the present invention comprises an elongated piece of aluminum, or the like canister 62 defining a square, hollow cross-section that is attached to the adjustable length stem 30 using a bracket 64. The bracket 64 is secured to the distal end of the adjustable length stem 30 using a bolt or other suitable means and has two prongs which extend forward to form a rotatable connection to the canister assembly 60 via bolts 66. As shown in greater detail in FIG. 4, the punching bag 70 is rigidly secured to a swivel shaft 72 via a cup-shaped insert 74 that is generally frustoconical in shape and attached thereto using adhesives, staples, or the like. A spring seat 76 is attached to the insert and swivel shaft 72 for vertical support of the punching bag 70 upon the spring 78. A section of connecting chain 80 having a predetermined length interconnects a swivel 82 attached to the bottom of the swivel shaft 72 to a chamber swivel 84 located therebelow. The chamber swivel 84 is slidably movable within the canister 62 yet is not allowed to rotate within the canister due to its generally square shape. A tensioning bolt 86 is attached to the chamber swivel 84 and is threadably received by a thumb-nut 88 disposed below the canister 62. Upper end-piece 90 fits snugly into the upper aperture of the canister 62 and provides a seat for the bottom end of the spring 78. Lower end-piece 92 fits into the lower aperture of the canister 62 and has an aperture for passage of the tensioning bolt 86 therethrough. Rotating the thumb-nut 88 in a clockwise direction causes the tensioning bolt 86 to move into the thumb-nut body and thus causes the spring 78 to be compressed accordingly. Conversely, rotating the thumb-nut in a counter-clockwise direction causes the tensioning bolt 86 to move out of the thumb-nut body and thus causes the spring 78 to be released. Thus, a user will be able to control the angular resonant frequency of the punching bag 70, or in other words, the speed at which the striking bag swings by selective rotation of the thumb-nut 88.

An optional adjustable backstop arrangement 100 embodying the present invention defining a type of rebounding means comprises a generally rectangular shaped board 102 which causes the punching bag 70 to bounce back towards the user when struck thereby. The position of the board 102 relative to the punching bag 70 is adjustable thereby providing further manipulation of the speed at which the punching bag 70 swings when struck by a user. For novice users, the backstop may be positioned such that a large angular displacement of the punching bag 70 relative to the canister assembly 60 is necessary in order to 'bounce' the punching bag 70 back towards the user. As skill and agility are attained through practice with the device, the backstop may be incrementally repositioned such that a smaller angular displacement of the punching bag 70 relative to the canister assembly 60 is necessary in order to 'bounce' the punching bag 70 back towards the user. Moreover, the speed of the bag can be manipulated by the relative positioning of the board 102. The backstop may be made of any suitable material, preferably fiberboard, or the like and is attached to the generally upright surface of a L-shaped bracket 104 using bolts which extend through apertures in the backstop and L-shaped bracket. A ball mount arrangement 106 is attached to the lower surface of the L-shaped bracket 104 thereby defining a mounting position for the flange of the ball mount arrangement 106 that is perpendicular to the surface of the board 102. Another ball mount arrangement 108 of similar design and size is attached to the outer surface of the canister 62 opposite the adjustable length stem 30. The ball mount arrangements (106 and 108) each have a ball 110 which is swivelly mounted in sockets formed by two elongated pieces of material defining a dual socket arrangement 112 having concave socket cavities 114 located at the ends to receive each ball therein. The ball mount arrangements (106 and 108) and dual socket arrangement 112 may be constructed of any suitable material, such as lightweight aluminum. A bolt 116 extends through holes 118 intermediate the socket cavities of the dual socket arrangement 112 and serves to rigidly hold the backstop 102 at any user selectable angular orientation with respect to the canister assembly 60 when tightened.

Figure 2:
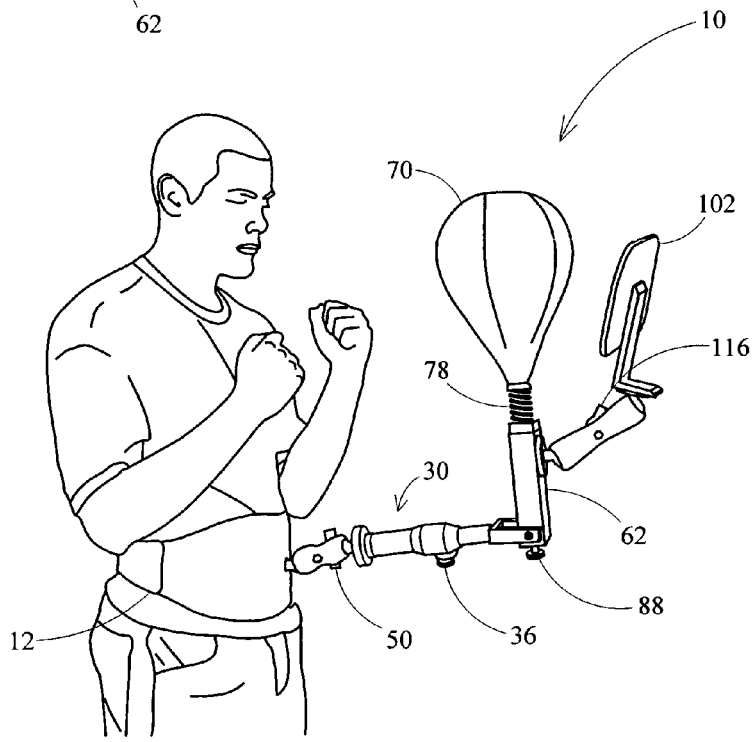
FIG. 2 is a perspective view of the embodiment of FIG. 1 shown releasably mounted in operative engagement on the waist of a user.

FIG. 2 shows a preferred embodiment of the present invention in operative engagement mounted on the waist of a user. To use the device, a user will strap the belt assembly 12 around his or her waist using the buckle arrangement. Next, the angular orientation of the adjustable length stem 30 as well as its length is adjusted via adjustment bolt 50 and thumbscrew 36. The angular orientation of the adjustable length stem 30 is accomplished by loosening the adjustment bolt 50 and swiveling the adjustable length stem 30 to the desired orientation and then tightening the bolt. It is important to note that the adjustment bolt 50 allows not only elevational selective adjustment of the canister assembly 60 relative to the user, but also lateral adjustment thereof as well. Thus, a user may proportionally position the canister assembly 60 to either side of their waist in order to mimic an actual boxing scenario wherein mostly the side of a user faces the intended target rather facing the target 'head-on'. The adjustment of the distance of the canister assembly 60 from the waist is accomplished by loosening thumbscrew 36 and incrementally pulling extension rod 34 out of the hollow cylinder 32 in order to lengthen the distance or conversely, pushing the extension rod 34 into the hollow cylinder 32 in order shorten the distance and then tightening the thumbscrew 36. These two adjustment mechanisms are used in tandem in order to set the punching bag 70 at the desired height and distance from the user. The user may then test the bag using several swings to test the speed of the bag and then adjust the thumb-nut 88 to set the desired speed of the bag 70 and the bolt 116 to set the angle at which the bag 70 bounces back toward the user. Alternatively, if the bounce action from the backstop 102 is not desired, the user may easily remove the backstop assembly 100 by completely disengaging the bolt 116 and removing the backstop assembly 100 from the device.

Figure 5:
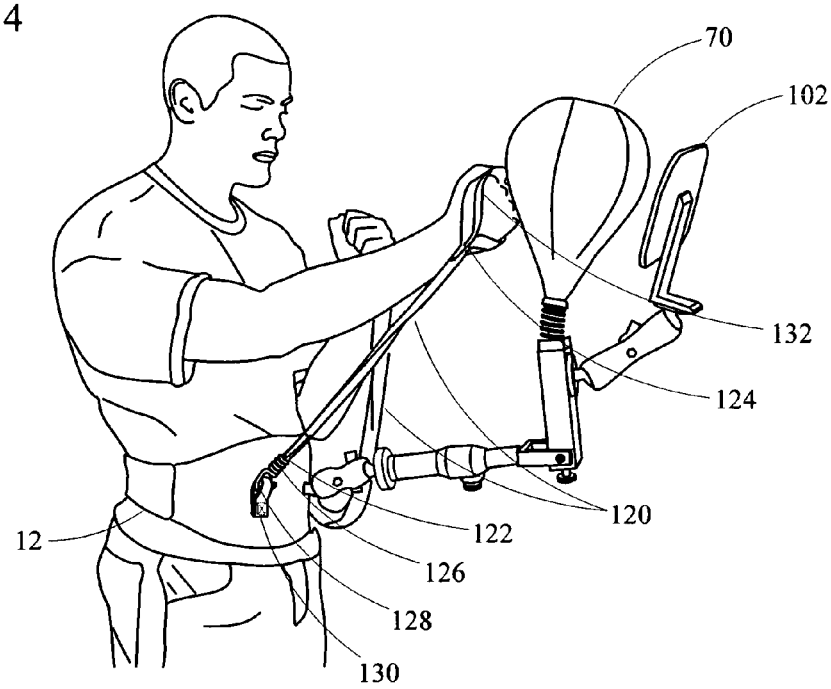
FIG. 5 is a perspective view of an alternate embodiment of the present invention having resistance straps that elastically couple the hands of the user to the belt assembly to further aid in physical training of the user.
Figure 6A:
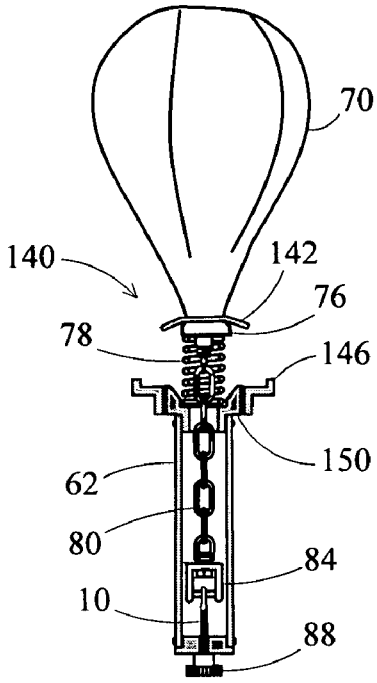
FIG. 6*a* is an elevational sectional view of the canister assembly of FIG. 10 shown with alternative rebounding means comprising an impact plate and disk arrangement with the front side of the spring, canister, end-pieces, round-shaped disk, and impact plate, cut away, wherein the bag is shown in a generally upright orientation with the spring means in its quiescent state.
Figure 6B:
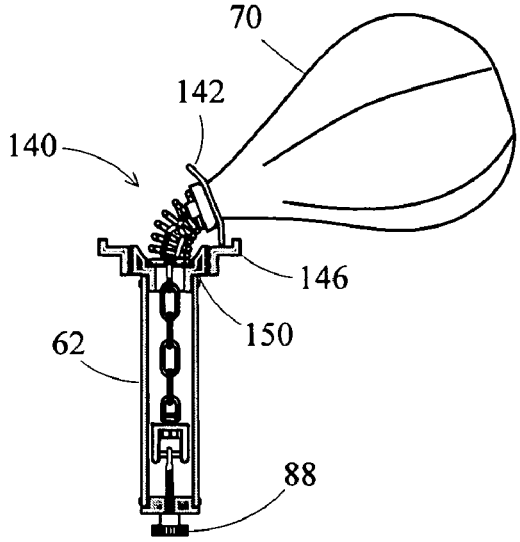
FIG. 6*b* is an elevational view of the canister assembly of FIG. 6*a* shown with the round-shaped disk contacting the impact plate wherein the angular orientation of the punching bag diverted to its maximum angular displacement relative to the canister.
Figure 7A:
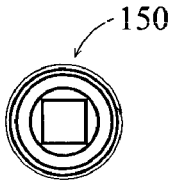
FIG. 7*a* is a plan view of the upper end-piece of the alternative rebounding means of FIG. 10.
Figure 8A:
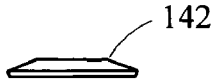
FIG. 8*a* is a side elevational view of the round-shaped disk of the alternative rebounding means of FIG. 10.
Figure 9A:
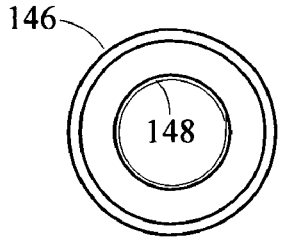
FIG. 9*a* is a plan view of the impact plate of the alternative rebounding means of FIG. 10.
Figure 7B:
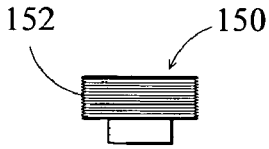
FIG. 7*b* is a side elevational view of the upper end-piece of FIG. 7*a*.
Figure 8B:
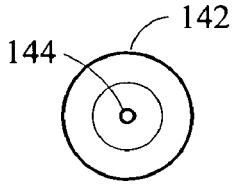
FIG. 8*b* is a plan view of the round-shaped disk of FIG. 8*a*.
Figure 9B:
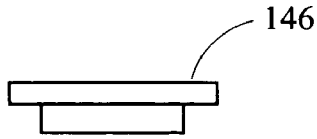
FIG. 9*b* is a side elevational view of the impact plate of FIG. 9*a*.
Figure 10:
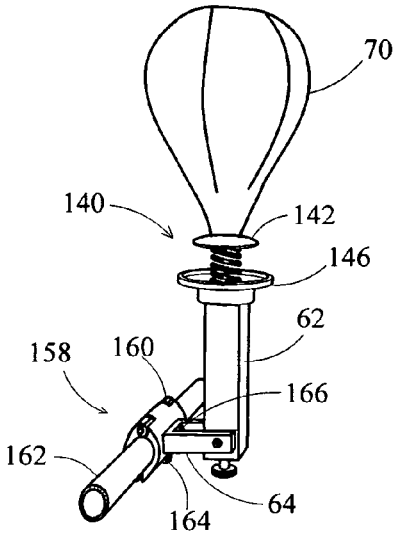
FIG. 10 is a perspective view of an alternative embodiment of the present invention shown having a mounting means comprising of a split collar for attachment to any cylindrical object and an alternative rebounding means.

It is contemplated that resistance straps 120 may be used as shown in FIG. 5. Two resistance straps would be used, one for each hand of the user to provide resistance during the punching motion to provide an extra measure of conditioning for the muscles in the user's arms. The resistance straps 120 may each be made from an elongated section of elastic rubber or the like defining a proximal end 122 and distal end 124. The proximal end 122 is attached to a coil of wire 126 which is embraced therein via a snug fit. The end of the wire defines a wire hook 128 which may be inserted into a belt loop 130. The belt loop 130 is constructed of an elongated section of material, preferably leather and is attached to the front of the belt assembly 12 via stitching or the like. The distal end 124 is doubled back and attached to itself via stitching or the like thus forming a hand loop 132 which may be placed over each hand of a user. To use, the hooks 128 of each resistance strap 120 would be placed in a belt loop 130 and the corresponding hand loop 132 placed around the hand of the user. The user would then practice the device as in the previous embodiment.

An alternative rebounding mechanism 140 along with an alternative punching bag mounting means 158 is shown in FIGS. 6 through 10 in which a round-shaped disk 142 is adapted to make contact with an adjustable impact plate 146 in order to provide a bouncing action to the punching bag 70 when a user selectable maximum angular displacement thereof relative to the canister 62 is attained during use. The alternative rebounding mechanism 140 comprising a disk 142 and adjustable impact plate 146 could be used in lieu of the adjustable backstop arrangement 100 of the previous embodiment. The canister 62, bracket 64, swivels (82 and 84), spring seat 76, chain 80, spring 78, tensioning bolt 86, lower end-piece 92, and thumb-nut 88 are similar in design and purpose to the embodiment of FIGS. 1 through 5. However the current embodiment differs in that an upper end-piece 150 which fits snugly into the upper aperture of the canister 62 providing a seat for the bottom of the spring 78 also has a cylindrical portion 152 integrally formed therewith for adjustable support of the impact plate 146. The outer periphery of the cylindrical portion 152 has threads to threadably receive the threaded inner aperture 148 of the impact plate thereby allowing the impact plate 146 to be adjusted downwards or upwards relative to the canister 62 by rotation thereof in a clockwise or counter-clockwise direction respectively. The disk 142 has an aperture 144 formed in the center thereof to accept the swivel shaft 72 therethrough and is securely held in rigid orientation relative to the punching bag 70 by being sandwiched in between the insert 74 and spring seat 76. Thus the user may rotate the impact plate in order to adjust the maximum angular displacement which the punching bag 70 travels during use. To cause the bag 70 to have a slower effective speed, the impact plate 146 would be rotated clockwise in order to increase the maximum angular displacement that the bag 70 is allowed to travel, and conversely, the plate 146 would be rotated in a counter-clockwise direction in order to decrease the maximum angular displacement and thus increase the effective speed or action of the bag.

The current embodiment also incorporates a punching bag mounting means defining a split collar mechanism 158 which provides for releasable attachment to any cylindrical structure including bars of exercise equipment such as exercise machines, exercise bars, treadmills, stationary bicycles, and the like. In fact, multiple punching bag devices of the present invention may be temporarily mounted proximate each other (not shown) in order to further challenge the skill of a user wherein the repetitious sequence of coordinating the bouncing actions of multiple bags is required. The split collar mechanism 158 is provided with a hinge 160 which allows placement over any cylindrical structure 162 of indeterminate length and a collar bolt 164 which locks the collar 158 in any user selected position. The collar 158 may be secured to the bracket 64 using any suitable means, preferably a bolt 166 which allows the collar 158 to be selectively rotated relative to the bracket 64 and is locked into position via axially serrated surfaces (not shown) therebetween. Thus, the punching bag of the current embodiment may be releasably affixed to a cylindrical structure having any orientation by removing the collar bolt 164, placing the split collar 158 over the desired portion of the cylindrical structure, and then inserting and tightening the bolt 164 until the cylindrical structure is firmly embraced thereby. Next, the bolt 166 is temporarily loosened to adjust the orientation of the canister and the bolt 166 re-tightened. The aforementioned embodiment described the use of a split collar device as a mounting means for the punching bag of the present invention, however it will be appreciated by those skilled in the art that other forms of mounting means which enable releasable attachment to virtually any firm foundational structure would be a viable alternative; an example of one such alternative is a flange mount device which enables releasable attachment of the punching bag system to a flat object such as a wall. In addition, the aforedescribed embodiment disclosed a canister 62 which was directly mounted to the split collar 158 via the bracket 64; however the stem 30 as described in the embodiment of FIGS. 1 through 5 may also be implemented in order to provide a punching bag system whose height is independently adjustable relative to the height of the cylindrical structure 162.

Figure 11:
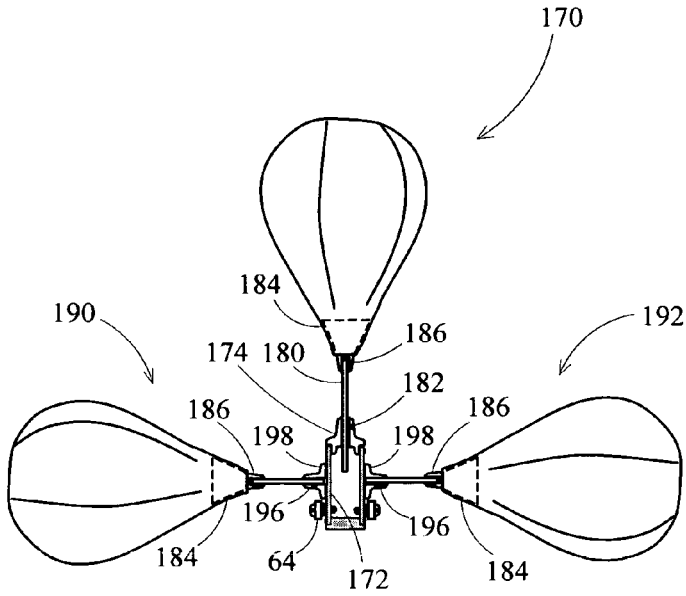
FIG. 11 is a side elevational view of an alternative embodiment of the present invention having a spring means comprised of rod-shaped composite material and two additional side bags mounted on the sides of the canister assembly wherein the punching bag mounting means has been omitted from the figure for clarity.
Figure 12:
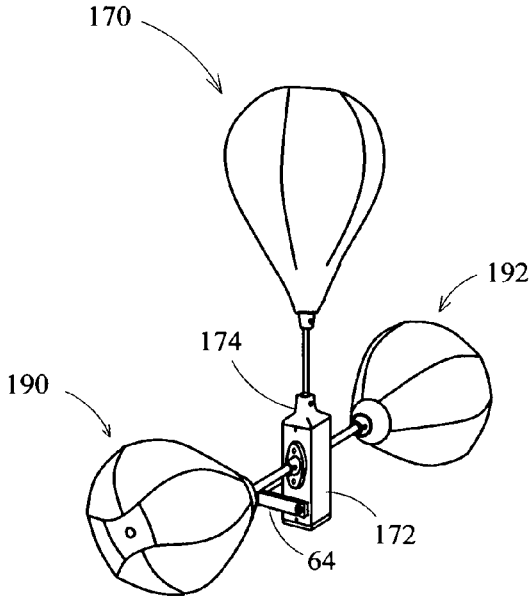
FIG. 12 is a perspective view of the embodiment of FIG. 11 wherein the punching bag mounting means has been omitted from the figure for clarity.

Another alternative embodiment 170 of the present invention comprises spring means which is defined as a composite flexible rod, preferably a fiberglass impregnated polyester rod for flexible movement of the punching bag 70 about a canister 172 as shown in FIGS. 11 and 12. Additionally, optional left 190 and right 192 side-bag arrangements are included in order to form a multi-bag arrangement for further enhancement of the exercise regimen. No punching bag mounting means are shown in the drawings for the purpose of clarity of description; nevertheless, it is to be understood that either the waist mounted punching bag mounting means as described in FIGS. 1–5 or a cylindrical structure punching bag mounting means as described in FIGS. 6–10 would be viable alternatives. It is important to note that the adjustable length stem 30 as described in FIGS. 1–5 should be incorporated with the embodiment of FIGS. 6–10 if optional left 190 and right 192 side-bag arrangements are used in order to allow freedom of movement thereof due to the indeterminate length bar 162 in close proximity thereto.

The device 170 generally comprises a canister 172 comprising an elongated section of material, preferably aluminum, defining a square, hollow cross-section having upper and lower ends. The canister is attached to any punching bag mounting means via bracket 64 in a manner as hereinbefore described. An upper end-piece 174 which has a flanged surface at its lower extremity for providing a snug fit over the upper end of the canister 172 and is held thereto using screws. The upper end-piece 174 also has a tube integrally formed therewith for receipt of the bottom portion of a section of flexible rod 180 therein and is releasably held in a user selectable position via set screw 182. Conversely, the top portion of the flexible rod 180 is rigidly secured to the bottom of the punching bag 70 via a cup-shaped insert 184 whose exterior surface is generally frustoconical in shape in conjunction with a rod attachment member 186 attached thereto. The rod attachment member 186 has a downwardly depending tube integrally formed therewith for receipt of upper end of the flexible rod 180 therein. The flexible rod of the present embodiment is made from a 3/16 inch thick section of solid, round cross-section fiberglass reinforced polyester rod, however it is well known in the art that there are other types of composite materials exhibiting good resilient characteristics which would be a valid substitute. Nevertheless, the cross-sectional shape of the rod may be any shape, in fact, the resiliency of the rod with respect to the forward/backward movement as opposed to the sideways movement thereof may be tailored by the use of non-symmetrical shapes such as oval, or egg-shaped cross-sectional shapes. It is to be understood that varying the thickness of the rod will also effect a corresponding change in the action or speed of the bag; that is, a rod having a thicker cross-section will cause the bag to have a faster action and a thinner rod will cause the bag to have a slower action. Nevertheless, the speed or action of the punching bag 70 is immediately adjustable by the user via set screw 182. Thus, the speed of the bag 70 may be adjusted by loosening the set screw 182, lowering or raising the rod 180 from the upper end-piece 174 in order to increase or decrease the action of the bag respectively, and then re-tightening the set screw.

The optional left 190 and right 192 side-bag arrangements each comprise a flexible rod 180, insert 184, and rod attachment member 186, which is similar in design and purpose to vertically oriented punching bag 70, however both side bag arrangements (190 and 192) differ in that the lower end of the flexible rod 180 are secured to the sides of the canister 172 via side-bag mounts. The side-bag mounts essentially comprise a tube member 196 which is integrally attached to a flange member 198 for releasable securement to the sides of the canister 172 using conventional bolts. Thus, if use of either of the side-bag arrangements (190 and 192) is not desired, they may be removed from the canister 172 by removing the bolts which hold the side-bag mounts in place and storing the side-bags away from the punching bag system.

Figure 13:
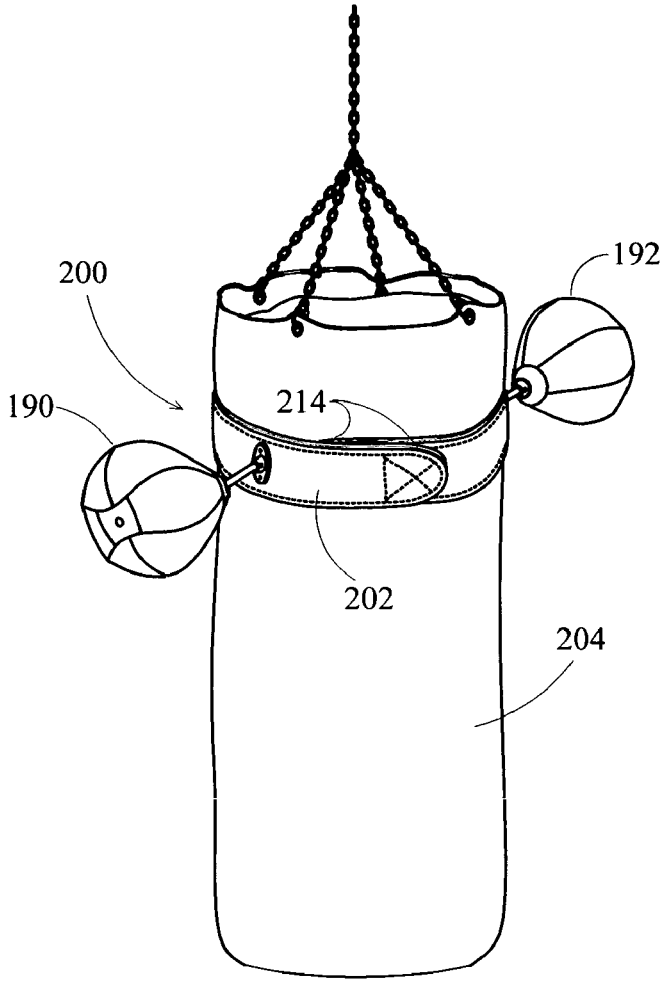
FIG. 13 is a perspective view of an alternative embodiment of the present invention having an alternative punching bag mounting means comprising an annular belt which is adapted for releasable attachment around the periphery of a conventional heavy bag.
Figure 14:
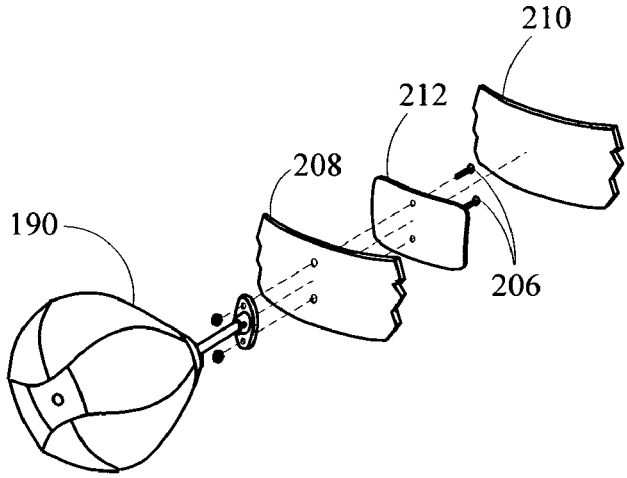
FIG. 14 is an exploded perspective view of one portion of the embodiment of FIG. 13 showing the assembly of layers of the annular belt with respect to mounting means of one of the side bags.

Another alternative device according to the present invention contemplates a punching bag mounting means 200 comprising a support belt 202 for releasable attachment of a punching bag of the instant invention to a heavy bag 204 as shown in FIGS. 13 and 14. The mounting means described in this embodiment along with the mounting means as described in the aforementioned embodiments, serves to demonstrate the widely varied types of mounting means that may implemented with a spring means supported punching bag which is capable of placement in any user selected orientation and on virtually any type of structural object. The present embodiment 200 utilizes two side bag arrangements (190 and 192) as described in the embodiment of FIGS. 11 and 12 which are mounted to the support belt 202 using conventional bolts 206 and their associated nuts. The support belt 202 may be constructed from any flexible, high tensile strength material, preferably leather, which can withstand relatively large amounts of physical abuse without ripping or tearing. In addition, the support belt 202 is preferably constructed from two essentially equally sized pieces of leather material defining an outer layer 208 and an inner layer 210 which are sewn together along their outer periphery with two belt stiffening plates 212 sandwiched therebetween. The two belt stiffening plates 212 are disposed a predetermined distance apart within the belt such that each of the side bag arrangements (190 and 192) will be positioned at generally opposing sides of the heavy bag 204 when releasably attached thereto. The belt stiffening plates 212 are preferably made of 16 gauge carbon steel, and serve to distribute the torsional forces placed on the support belt 202 by each of the side bag arrangements (190 and 192). FIG. 14 shows an exploded view of the arrangement of layers demonstrating the attachment means of the left side bag arrangement 190 to the support belt 202 via one of the belt stiffening plates; however, it is to be understood that the attachment means of the right side bag arrangement 192 is substantially similar to the left side bag arrangement 190 and is thus not shown in the drawings. The ends 214 of the support belt are held together while in the installed position using hook-and-loop fastening material (not shown), although it is well known in the art that other attachment devices such as buckles may be a suitable alternative. To use, the support belt 202 is wrapped around a conventional heavy bag 204 with both of the side bag arrangements oriented radially outwards therefrom. Next, the ends of the belt 214 are pulled toward each other in order to provide a tight constricted friction fit of the outer surface of the heavy bag 204 thereto and the ends 214 pressed together in order to engage the hook-and-loop fastening means. When the heavy bag 204 is struck by a user, the resulting movement thereof will impart relatively fast resonant motion into each of the side bags (190 and 192) due to the resilience of the flexible rods 180. Thus, the side bags arrangements (190 and 192) will enhance the challenge of a conventional heavy bag 204 by providing a swiftly moving target requiring dodging or striking skills that was heretofore not known to the use of a conventional heavy bag.

The present invention may be embodied in other specific forms without departing from the spirit or scope of the invention. For example, a disclosed preferred embodiment disclosed the use of a split collar for releasable attachment to a cylindrical structure, however it is well known in the art that other devices may also be used which would be capable of mounting the punching bag of the present invention to virtually any support object. The described embodiments therefore are to be considered in all respects only as illustrative and not restrictive. The scope of the invention is, therefore, indicated by the appended claims rather than by the foregoing description. All changes which come within the meaning and range of equivalency of the claims are to be embraced within their scope.

I claim:

1. A portable and fully adjustable punching bag exercise system comprising:

at least one punching bag which provides a target to be struck by the fist of a user;

a punching bag mounting means which comprises a belt assembly for releasable attachment to the waist of the user for support of said at least one punching bag in any user selected orientation;

said punching bag mounting means also having height adjustment means for support of said at least one punching bag at essentially any height relative to said user;

said mounting means is interconnected to said punching bag;

a spring means which is relatively resilient in consistency for imparting a rapid pendulum-like resonant action to said punching bag due to said punching bag being struck by the first of a user, said spring means having a resiliency adjustment means for changing the effective resonate speed which the bag moves when struck by said user, said resiliency adjustment means is generally independent of the height of the bag relative to said user; and wherein said punching bag mounting means includes an adjustable length stem having proximal and distal ends for supporting said spring means at a user selectable distance from said belt assembly, the proximal end of said adjustable length stem is swivelly interconnected to said belt assembly in order to allow said spring means to be supported in essentially any radial position relative to said belt assembly, and said distal end of said adjustable length stem is swivelly interconnected to said spring means in order to allow said punching bag to be supported in essentially any user selected orientation.

2. The portable and fully adjustable punching bag system of claim 1, further comprising:

at least one resistance strap defining an elongated section of elastic material defining a proximal end and a distal end, the proximal end of said resistance strap is releasably attached to said belt assembly, the distal end of said resistance strap is attached to said resistance strap intermediate said proximal and distal ends in order to form a loop for the placement of a hand of said user therein.

3. The portable and fully adjustable punching bag system of claim 1, wherein:

said spring means is a metallic coil spring having a proximal and distal end; and, resiliency adjustment means is a spring tensioning means which is interconnected to the proximal and distal ends of said metallic coil spring, said tensioning means is tensionably adjustable to adaptively modify the resilience of said coil spring and thus enable the adjustment of the resonant speed at which said punching bag moves when struck by the fist of the user.

4. The portable and fully adjustable punching bag system of claim 1, wherein said rebounding means is an adjustable backstop comprising a generally rectangular shaped board which causes said punching bag to bounce back towards the user when contacted thereby, said board is swivelly mounted to said spring means at a user selectable lateral distance from said punching bag which is generally opposite the position of said user.

* * * * *